United States Patent [19]

Cheng

[11] Patent Number: 4,639,153

[45] Date of Patent: Jan. 27, 1987

[54] PRINTING RIBBON SPOOL HAVING AN INK RESERVOIR AND METHOD OF MAKING SAME

[75] Inventor: Wei-Tsang Cheng, Waterbury, Conn.

[73] Assignee: Jing Tech, Inc., Bethany, Conn.

[21] Appl. No.: 628,762

[22] Filed: Jul. 9, 1984

[51] Int. Cl.[4] ..... B41J 31/14

[52] U.S. Cl. ..... 400/202.1; 400/202.3; 400/242

[58] Field of Search ..... 400/197, 198, 199, 200, 400/201, 202, 202.1, 202.2, 202.3, 202.4, 242; 219/150 R, 150 V, 152; 227/51, 52, 55, 58, 59

[56] References Cited

U.S. PATENT DOCUMENTS

| | | | |
|---|---|---|---|
| 866,644 | 9/1907 | Green | 227/52 X |
| 1,804,976 | 5/1931 | Fortier | 400/202.4 X |
| 2,158,944 | 5/1939 | Pelton | 400/202.4 |
| 2,325,480 | 7/1943 | Crawford | 219/152 |
| 2,695,092 | 11/1954 | Pelton | 400/202.4 X |
| 2,761,539 | 9/1956 | Furman et al. | 400/202.1 |
| 2,869,706 | 1/1959 | Bishop | 400/202.1 |
| 3,819,026 | 6/1974 | Ploeger, Jr. et al. | 400/202.1 |
| 4,127,337 | 11/1978 | Bishop | 400/202.4 |
| 4,340,313 | 7/1982 | Bishop | 400/202.1 |

*Primary Examiner*—Ernest T. Wright, Jr.
*Attorney, Agent, or Firm*—Felfe & Lynch

[57] ABSTRACT

A printing ribbon spool which is leak-proof even at less than atmospheric pressure and which has an indefinite shelf life. The spool utilizes a central hub as an ink reservoir and has an ink-impervious member forming a portion of the reservoir isolating the ink from an ink-delivery pad before actuation. The central tubular portions of the spool are interlocked in such a manner that the spool is leak-proof. The ink-impervious member can be pierced by a pin to actuate the spool. Air compensation grooves are utilized to maintain air flow which results in uniform distribution of the ink throughout the pad. The edge of the ribbon contacts the pad and becomes saturated by capillary action to provide uniform and consistent printing for millions of characters.

5 Claims, 12 Drawing Figures

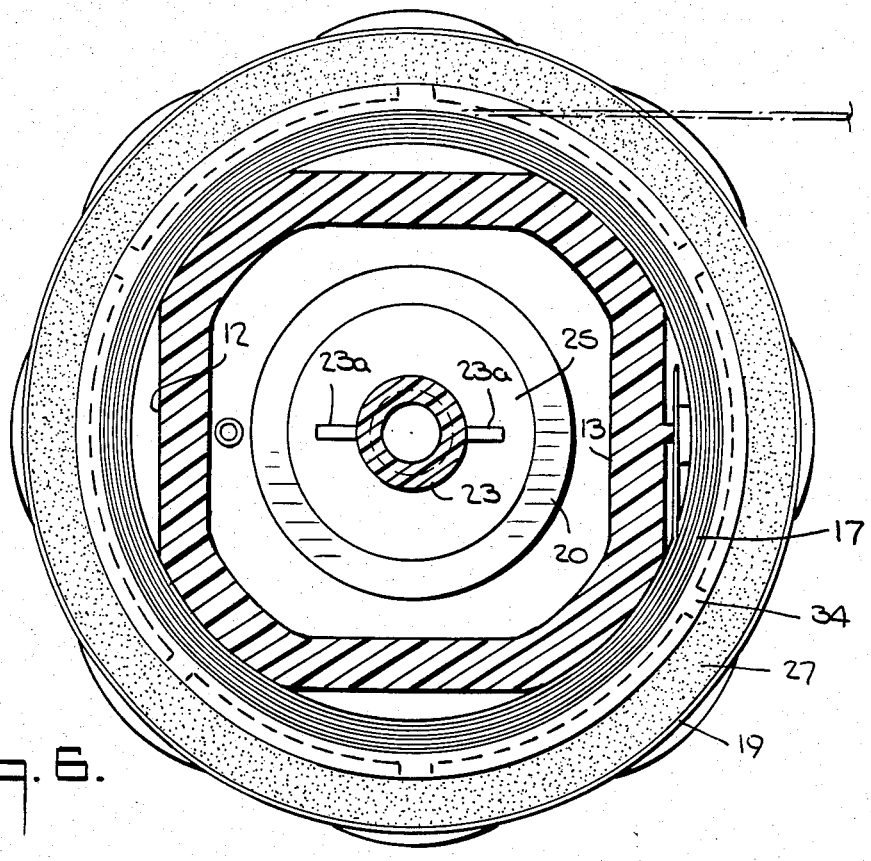
Fig. 6.
Fig. 7.
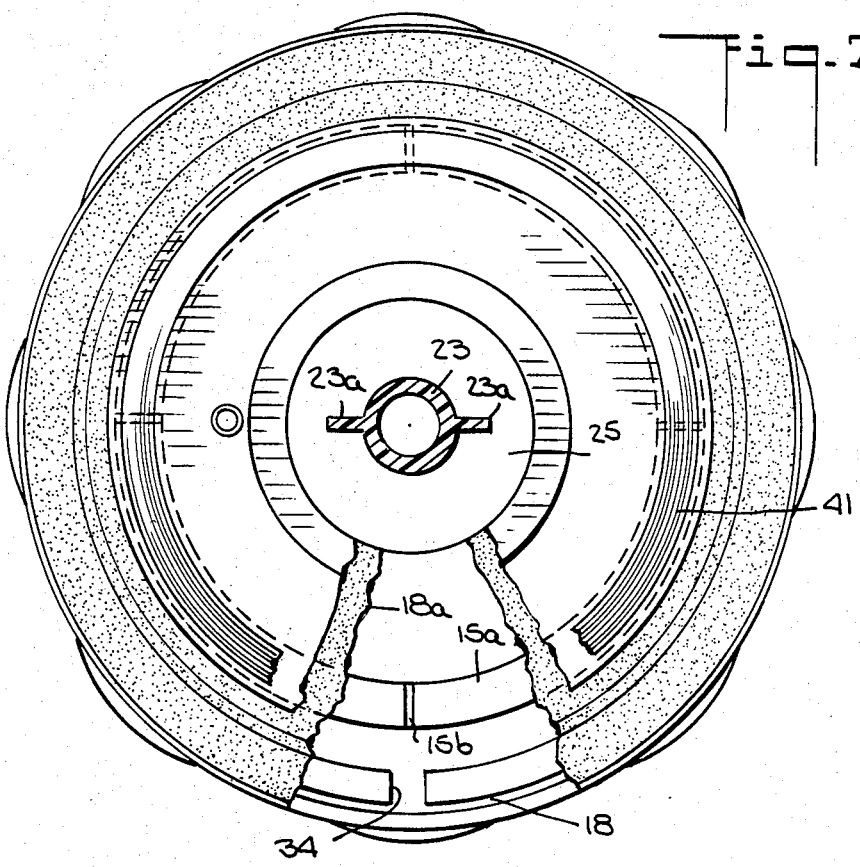

PRINTING RIBBON SPOOL HAVING AN INK RESERVOIR AND METHOD OF MAKING SAME

This invention relates to printing ribbon spools and to methods of making the same and, more particularly, to printing ribbon spools which may be generally of the type disclosed and claimed in U.S. Pat. No. 4,340,313—Bishop.

Heretofore, such printing ribbon spools were subject to the limitation that they could not be shipped as air cargo because the ink reservoirs occasionally leaked when the spools were at less than atmospheric pressure.

It is an object of the present invention, therefore, to provide a new and improved printing ribbon spool which avoids one or more of the disadvantages and limitations of prior such spools.

It is another object of the invention to provide a new and improved printing ribbon spool which can be shipped as air cargo without leakage from the ink reservoir thereof.

It is another object of the invention to provide a new and improved method of making a printing ribbon spool which renders the spool leak-free at atmospheric and less than atmospheric pressures.

It is another object of the invention to provide a new and improved printing ribbon spool which has an indefinite shelf life prior to use.

It is another object of the invention to provide a new and improved printing ribbon spool which can be readily actuated for use.

It is another object of the invention to provide a new and improved printing ribbon spool which provides uniform and consistent type print for millions of characters.

It is another object of the invention to provide a new and improved end cap for a printing ribbon spool which provides several functions for the printing ribbon spool.

It is another object of the invention to provide a new and improved printing ribbon which provides uniform and consistent print for millions of characters.

It is another object of the invention to provide a new and improved method of making a printing ribbon which renders the ribbon capable of providing uniform and consistent print for millions of characters.

In accordance with the invention, a printing ribbon spool comprises a spool body, the spool body having a hub forming at least a portion of an ink reservoir and having spaced flanged portions extending radially outwardly from the hub. The hub is between the spaced flange portions and has a surface to receive a ribbon wound thereon between the spaced flanged portions to define a zone of ribbon wrap. The ribbon advances toward and from the zone of ribbon wrap when the spool is wound and unwound, respectively. Ink-delivery means for the spool comprises an ink-delivery pad near one of the flanged portions. The ink-delivery pad has an exposed portion in the path of the advancing ribbon to contact a portion of the ribbon as the ribbon advances therepast. The ink-delivery pad communicates in ink receiving relation with the ink reservoir to receive ink from the ink reservoir and to convey the ink to the exposed portion of the ink-delivery pad. The spool includes ink-impervious means forming a portion of the ink reservoir disposed between the ink-delivery pad and ink in the ink reservoir to isolate the ink-delivery pad from ink in the ink reservoir. The ink-impervious means has at least one opening therethrough to permit ink to pass therethrough from the ink reservoir to the ink-delivery pad. The hub has a first centrally extending portion having a transverse shoulder therein and the hub has a second centrally extending portion seated against the shoulder. The first centrally extending portion has an end portion extending transversely against the second centrally extending portion to lock the centrally extending portions in leak-free engagement with each other.

Also in accordance with the invention, a method of making a printing ribbon spool comprises a spool body, the spool body having a hub with an ink reservoir and spaced flange portions extending radially outwardly from the hub. The hub is between the spaced flange portions and has a surface to receive a ribbon wound thereon between the spaced flange portions to define a zone of ribbon wrap. The ribbon advances toward and from the zone of ribbon wrap when the spool is wound and unwound, respectively. The spool includes ink-delivery means for the spool comprising an ink-delivery pad near one of the flange portions, the ink-delivery pad having an exposed portion in the path of the advancing ribbon to contact a portion of the ribbon as the ribbon advances therepast. The ink-delivery pad communicates in ink receiving relation with the ink reservoir to receive ink from the ink reservoir and to convey the ink to the exposed portion of the ink-delivery pad. The spool includes ink-impervious means forming a portion of the ink reservoir disposed between the ink-delivery pad and ink in the ink reservoir to isolate the ink-delivery pad from ink in the ink reservoir. The ink-impervious means has at least one opening therethrough to permit ink to pass therethrough from the ink reservoir to the ink-delivery pad. The hub has a first centrally extending portion having a transverse shoulder therein and the hub also has a second centrally extending portion having a transversely extending portion and a longitudinally extending portion. The method comprises disposing the second centrally extending portion over the first centrally extending portion with the transversely extending portion against the transverse shoulder and with the end portion of the first centrally extending portion extending beyond the end portion of the second centrally extending portion. The method also includes forming the end portion of the first centrally extending portion to extend over the portion of the second centrally extending portion to lock the centrally extending portions in leak-free engagement with each other.

Also in accordance with the invention, a printing ribbon device comprises a printing ribbon spool and a printing ribbon having a type slug impact area in a portion of the ribbon, the ribbon spool having a spool body. The spool body has a hub and spaced flange portions each extending radially outwardly from the hub. The hub is between the flanges and has a surface to receive the ribbon wound thereon between the flanges. The device includes a pad near one of said flanges and having a portion thereof exposed in ribbon-contacting position near the outer edge of one of the flange portions. The device also includes an ink reservoir in the hub, the pad communicating in ink-receiving relation with the ink reservoir to receive ink from the reservoir and to convey the ink to the exposed ribbon-contacting portion of the pad. The ribbon advances with a portion thereof in contact with the exposed portion of the pad to transfer ink from the pad to the portion of the ribbon. The ribbon has capillaries to transfer ink in the ribbon to the type slug impact area of the ribbon. The pad comprises an annulus having an annular portion extending under a substantial area of the ink reservoir. The device comprises solid annular means disposed in proximity to the pad and having apertures therein to permit air flow to the portion of the pad under the reservoir to maintain the pad substantially uniformly saturated over substantially its entire exposed portion which contacts the ribbon.

Also in accordance with the invention, a printing ribbon spool comprises a spool body and at least a portion of an ink reservoir in the spool body. The spool body has spaced flange portions extending outwardly. The spool body has a surface to receive a ribbon wound thereon between the spaced flange portions to define a zone of ribbon wrap, the ribbon advancing toward and from the zone of ribbon wrap when the spool is wound and unwound, respectively. The spool includes ink-delivery means for the spool comprising an ink-delivery pad near one of the flange portions. The ink-delivery pad has an exposed portion in the path of the advancing ribbon to contact a portion of the ribbon as the ribbon advances therepast. The ink-delivery pad communicates in ink receiving relation with the ink reservoir to receive ink from the ink reservoir when the spool is in an operating position and to convey the ink to the exposed portion of the ink-delivery pad. The spool includes ink-impervious means forming a portion of the ink reservoir disposed between the ink-delivery pad and ink in the ink reservoir to isolate the ink-delivery pad from ink in the ink reservoir. The ink-impervious means has at least one breakable portion and the spool includes means for breaking the portion to form an opening in the ink-impervious means to permit ink to pass therethrough from the ink reservoir to the ink-delivery pad.

Also in accordance with the invention, an end cap for a printing ribbon spool comprises a locking portion having a central aperture for the engagement of a mating member having a transverse shoulder, the locking portion having a transverse portion adjacent the aperture for seating against the transverse shoulder of the mating member. The cap includes an annular portion surrounding the locking portion having an obliquely disposed outer flange portion for positioning a pad thereon for contact with an advancing ribbon on the spool. The annular portion includes a solid annular rib having grooves therein to permit air flow from outside the solid annular rib to within the solid annular rib when the end cap is engaged with the mating member with a pad between the end cap and the spool body portion.

Also in accordance with the invention, a printing ribbon comprises an inking ribbon body having interstices therein for rendering the body ink-absorbent. The ribbon includes a material in the interstices of at least one end portion of the body for forming a coating on the end portion for rendering the end portion non-absorbent to ink.

Also in accordance with the invention, a method of making a printing ribbon comprises applying to an end portion of a printing ribbon a solution having a plastic material dissolved therein and drying the end portion of the printing ribbon to form a plastic coating on the end portion.

As used herein and in the appended claims, the term "pad" includes wicks of all types, for example, all shapes and all thicknesses.

For a better understanding of the present invention, together with other and further objects thereof, reference is made to the following description, taken in connection with the accompanying drawings, and its scope will be pointed out in the appended claims.

Referring now to the drawings:

FIG. 6 is a sectional view of the FIG. 4 spool taken along line 6—6 of FIG. 4;

FIG. 7 is a sectional view of the FIG. 4 spool taken along line 7—7 of FIG. 4, with the upper portion of the spool body removed for clarity;

Figure 4:
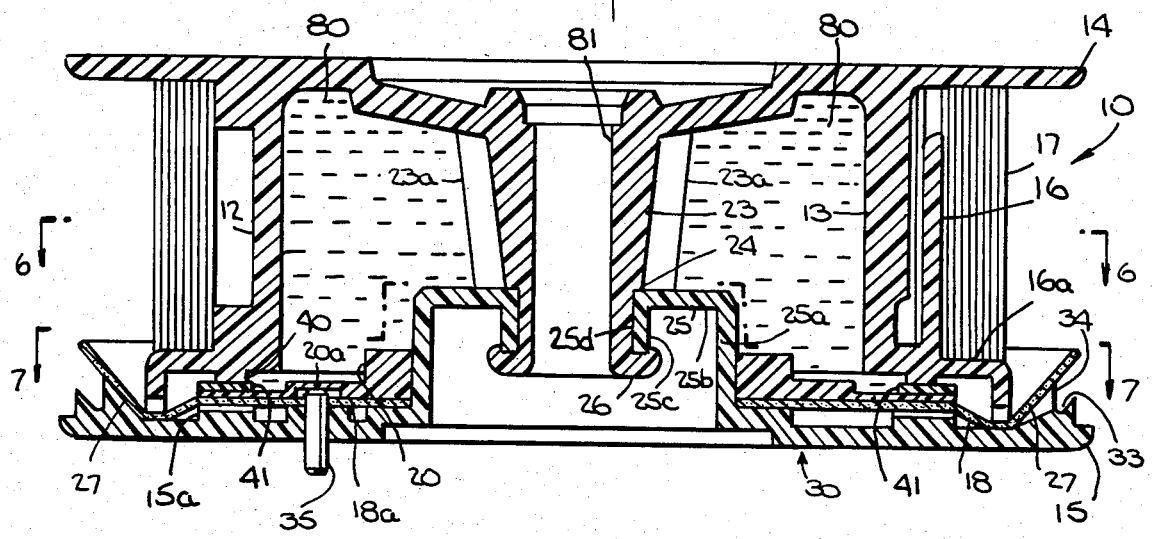
FIG. 4 is a sectional view, to an enlarged scale, of the FIG. 1 spool taken along line 4—4 of FIG. 1.

Referring now more particularly to FIGS. 1–6, inclusive, of the drawings, a printing ribbon spool 10, which preferably is of plastic, comprises a spool body 11 having a hub 12 forming at least a portion of an ink reservoir 13 which may be seen in FIG. 4. The spool body 11 has spaced flange portions 14, 15 extending radially outwardly from the hub 12. The hub 12 is between the spaced flange portions 14, 15 and has a surface 16 to receive a ribbon 17 wound thereon between the spaced flange portions 14, 15 to define a zone of ribbon wrap bounded by the inner surface of the flange portion 14, surface 16 and shoulder surface **16*a*, the ribbon 17 advancing toward and from the zone of ribbon wrap 14, 16, 16*a* when the spool 10** is wound and unwound, respectively.

The spool 10 includes ink-delivery means 18 for the spool comprising an ink-delivery pad 18 near one of the flange portions 15. The ink-delivery pad 18 has an exposed portion 19 in the path of the advancing ribbon 17 to contact a portion **17*b* of the ribbon 17 as the ribbon 17 advances therepast. The ink-delivery pad 18 communicates in ink-receiving relation with the ink reservoir 13 to receive ink 80 from the ink reservoir 13 and to convey the ink 80 to the exposed portion 19 of the ink-delivery pad 18. The pad 18** preferably is a commercially available spun-bonded polyester fibrous material made by du Pont under the trade mark Reemay, part No. 2470 of 0.027 inch thickness.

The spool 10 includes ink-impervious means 20 forming a portion of the ink reservoir 13 disposed between the ink-delivery pad 18 and ink 80 in the ink reservoir 13 to isolate the ink-delivery pad 18 from ink 80 in the ink reservoir 13. At least a portion of the ink-reservoir 13 is in the spool body 11. The ink-impervious means 20 has at least one opening 21 therethrough to permit ink 80 to pass therethrough from the ink reservoir 13 to the ink-delivery pad 18. Disposed between ink-impervious means 20 and spool body 11 preferably is a flexible, neoprene, ink-impervious washer 41 which prevents leakage from the ink reservoir 13. Such a washer is available from the Auburn Manufacturing Company, Middletown, Conn. as part No. "40 DURO NEOPRENE RING."

Referring now to FIG. 4, the hub 12 has a first centrally extending portion 23 having a spindle opening 81 and a transverse shoulder 24 therein, and the hub 12 has a second centrally extending portion 25 seated against the shoulder 24. The first centrally extending portion 23 has an end portion 26 extending transversely against the second centrally extending portion 25 to lock the centrally extending portions 23, 25 in leak-free engagement with each other. The portion 23 also may have, for example, ribs **23*a* to strengthen the portion 23**.

One of the flange portions 14, 15 is defined as an upper flange portion 14 when the spool 10 is in an operating position about a vertical axis and another of the flange portions 14, 15 is defined as a lower flange portion 15 with respect to the upper flange portion 14 when the spool 10 is in the operating position. The ribbon 17 has an upper portion **17*a* corresponding to the upper flange portion 14 and a lower portion 17*b* corresponding to the lower flange portion 15**.

The first centrally extending portion 23 of the spool 10 is a tubular portion extending downwardly of the hub 12. The transverse shoulder 24 is an external shoulder in the first centrally extending portion 23. The second centrally extending portion 25 has a tubular portion **25*a* extending upwardly of the hub 12, a transversely extending portion 25*b* seated against the shoulder 24 and a downwardly extending portion 25*c*. The end portion 26 of the first centrally extending portion 23 extends transversely outwardly of the first centrally extending portion 23. The flange portion 15 includes means comprising an oblique surface 27 (see FIG. 4) for positioning the exposed portion of the ink-delivery pad 18** in the path of ribbon advance.

A printing ribbon device comprises a printing ribbon spool 10 and a printing ribbon 17 having a type slug impact area in an upper portion **17*a* of the ribbon 17 which may be, for example, the upper three-eighths inch of a one-half inch wide ribbon. The ribbon has capillaries to transfer ink upwardly of the ribbon to the type slug impact area of the ribbon 17. The pad 18 comprises an annulus having an annular portion 18*a* extending under a substantial area of the ink reservoir 13. The printing ribbon device comprises solid annular means 15*a* disposed under the pad 18 and having apertures 15*b* therein to permit air flow to the portion of the pad 18 under the reservoir 13. Also, there preferably are provided, for example, eight grooves 11*a* uniformly spaced around the spool body 11 to permit air flow over the pad 18 to aid in maintaining the pad 18** substantially uniformly saturated.

The spool body 11 comprises an end cap 30 and the end cap 30 includes the solid annular means **15*a* having the apertures 15*b* therein. The device also includes a solid annular disk 20 disposed over the pad 18 to isolate the ink reservoir 13 from the pad 18**.

The solid annular means **15*a* comprises a ring having apertures 15*b*** therein.

Referring to FIG. 4, an end cap 30 for a printing ribbon spool 10 comprises a locking portion 25 having a central aperture **25*d* for the engagement of a mating member 23 having a transverse shoulder 24. The locking portion 25 has a transverse portion 25*b* adjacent the aperture 25*d* for seating against the transverse shoulder 24 of the mating member 23**.

Figure 2:
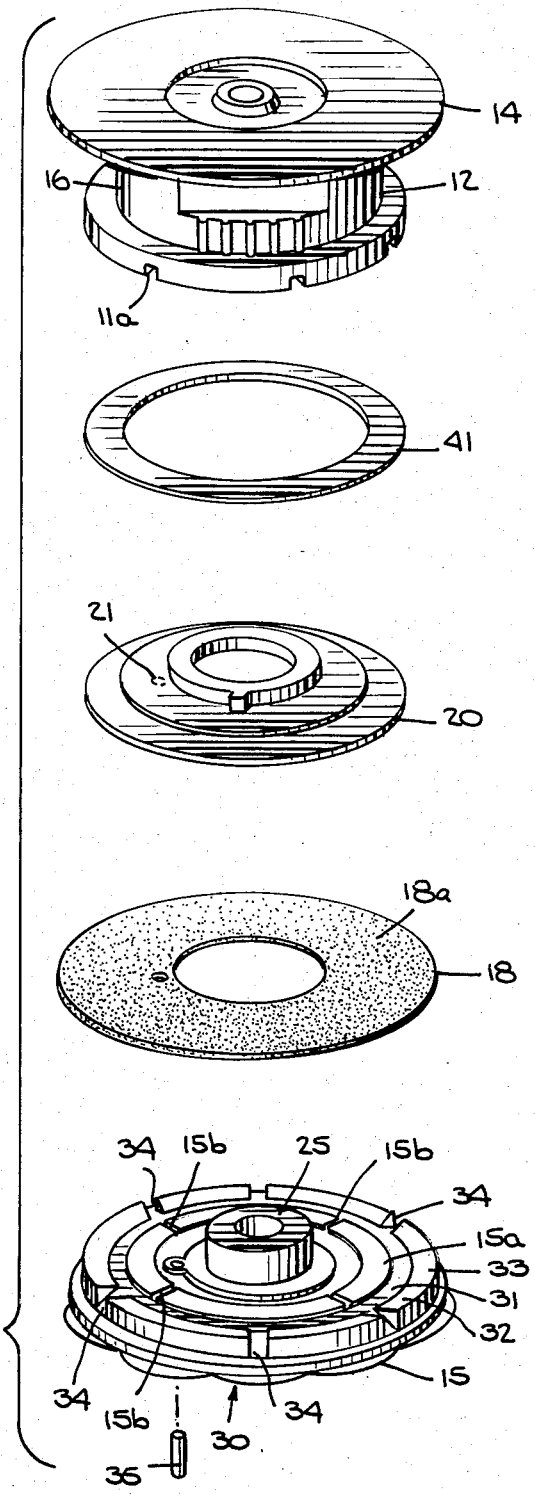
FIG. 2 is an exploded view of the FIG. 1 spool.

Referring to FIG. 2, an annular portion 31 surrounding the locking portion 25 has an obliquely disposed outer flange portion 32 for positioning a pad 18 thereon for contact with an advancing ribbon 17 on the spool 10. The annular portion 31 includes a solid annular rib **15*a* having grooves 15*b* therein to permit air flow from outside the annular rib 15*a* to within the solid annular rib 15*a* when the end cap 30 is engaged with the mating member 23 with a pad 18 between the end cap 30 and the spool body portion 40**.

Figure 5:
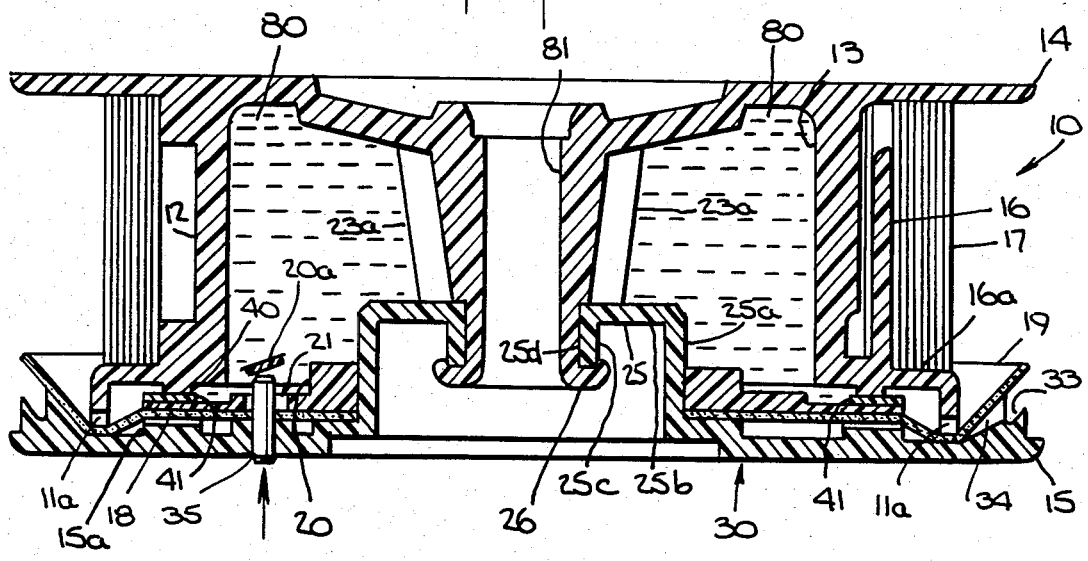
FIG. 5 is a sectional view of the FIG. 1 spool corresponding to the FIG. 4 view but with the ink reservoir of the spool having a broken seal and in operating condition.

The end cap 30 has an annular portion 31 having an outer annular groove 33 therein, which may best be seen in FIGS. 4 and 5, for providing an ink return channel 33 for excess ink, if any, in the exposed portion of the pad 18, and at least one transverse groove 34 for providing communication between the ink return channel 33 and the pad 18. Preferably there are six transverse grooves 34 spaced by substantially 60°.

As represented in FIGS. 4 and 5, the ink-impervious means 20 has at least one breakable sealing portion **20*a* and the spool 10 includes means preferably comprising a pin 35 for breaking the sealing portion 20*a* to form an opening 21 in the ink-impervious means 20 to permit ink 80 to pass therethrough from the ink reservoir 13 to the ink-delivery pad 18. The means for breaking the sealing portion 20*a* preferably comprises a displaceable pin 35. The pin 35 preferably is actuated by the printing machine and forms a leak-proof seal in the end cap 30** by a force-fit.

A method of making a printing ribbon spool 10 as previously described comprises disposing the second centrally extending portion 25 over the first centrally extending portion 23 with the transversely extending portion **25*b* against the transverse shoulder 24 and with the end portion 26, which preferably has a tubular shape, of the first centrally extending portion 23 extending beyond the end portion of the second centrally extending portion 25. The method includes forming the end portion 26 of the first centrally extending portion 23 to extend over the portion 25*c* of the second centrally extending portion 25 to lock the centrally extending portions 23, 25 in leak-free engagement with each other. The step of forming the end portion 26 of the first centrally extending portion 23 comprises rotating a forming tool 60, for example, as represented in FIG. 10 in contact with the end portion 26 of the first centrally extending portion 23** while it is in tubular shape to heat and form the same.

Figure 8:
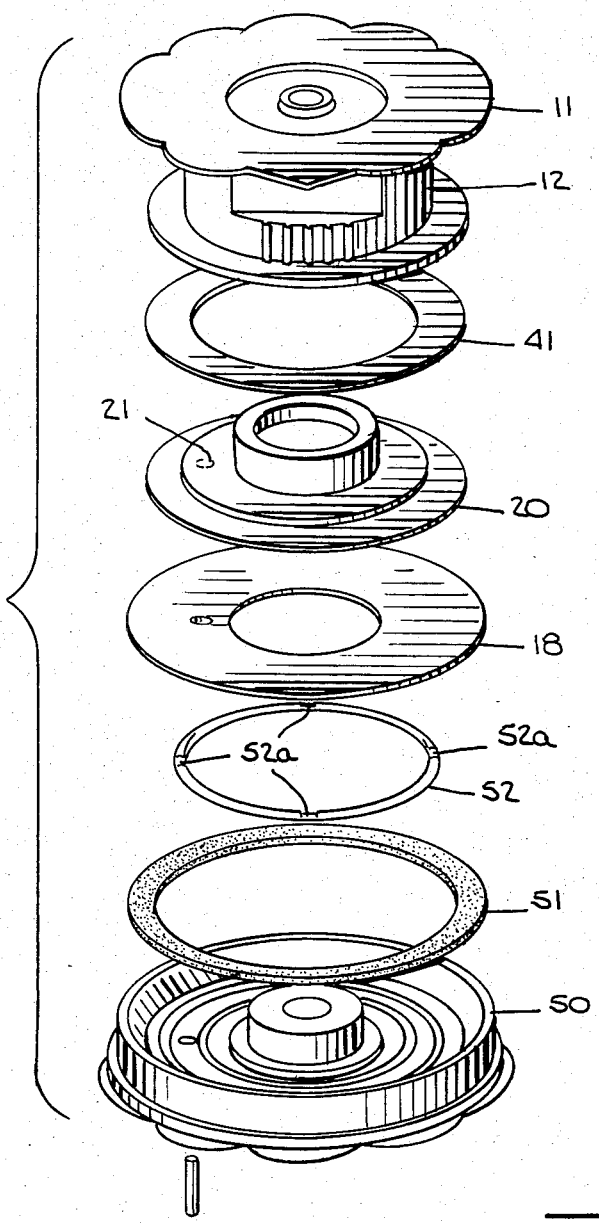
FIG. 8 is an exploded view of the components of another embodiment of the printing ribbon spool in accordance with the invention.
Figure 9:
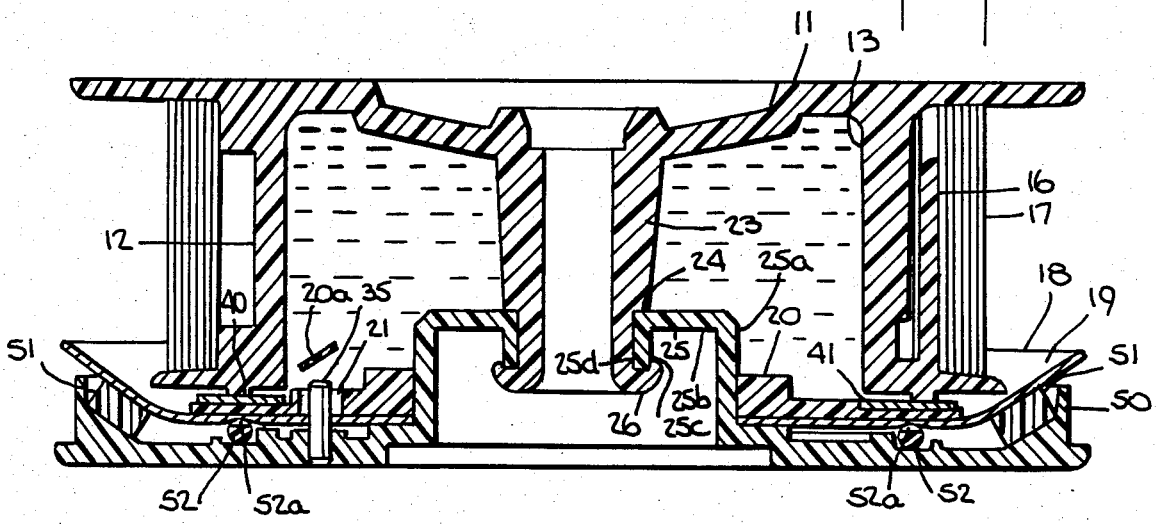
FIG. 9 is a sectional view, to an enlarged scale, of the FIG. 8 spool corresponding to the sectional view of the FIG. 1 spool represented in FIG. 5.

The inking spool embodiment of FIGS. 8 and 9 is generally similar to that described in connection with FIGS. 1 and 2. Similar parts thereof have been numbered by the same reference numerals. As will be apparent from the exploded view of FIG. 8 compared with the exploded view of FIG. 2, the pad 18, the ink-impervious member 20, the neoprene washer 41 and the spool body 11 are similar to components of the FIG. 2 embodiment of the same reference numerals. There is, however, a difference in construction of the end cap 50, a rubber washer 51 and a grooved nylon O-ring 52. The grooves **52*a* in the nylon O-ring 52 serve as air compensation grooves to allow air to enter the pad 18 and result in ink flow uniformly throughout the pad 18 in a manner similar to the air compensation grooves 15***b* of the end cap 30 of FIG. 2. As will be apparent from FIG. 9, the ring 15*a* otherwise forms a seal around the pad 18 which is positioned by the rubber washer 51 on the end cap 50. The end cap 50 does not contain an ink return channel similar to that of the end cap 30 of FIG. 2.

Figure 1:
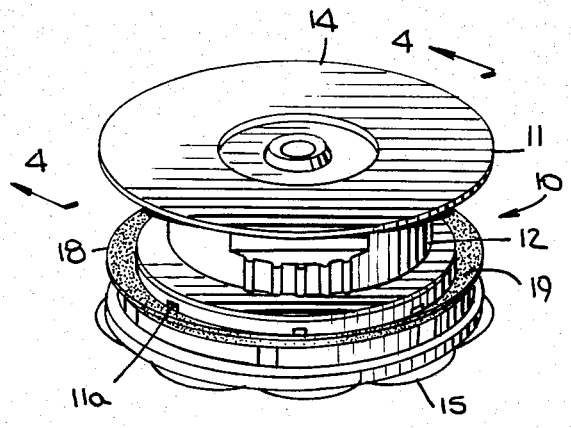
FIG. 1 is a perspective view of a printing ribbon spool constructed in accordance with the invention.
Figure 3:
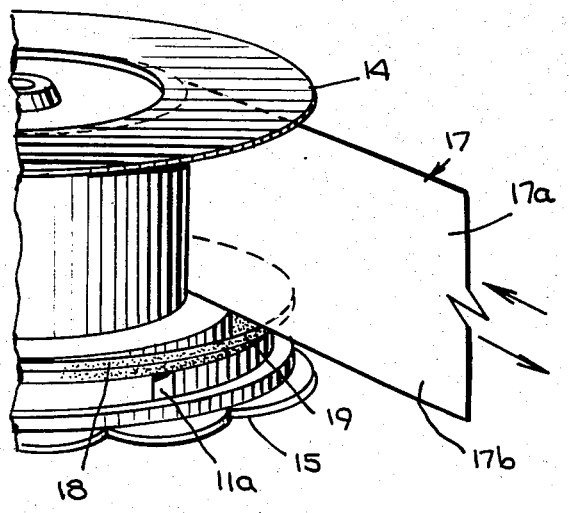
FIG. 3 is a fragmentary perspective view, to an enlarged scale, of the FIG. 1 spool having a printing ribbon thereon in operating condition.
Figure 10:
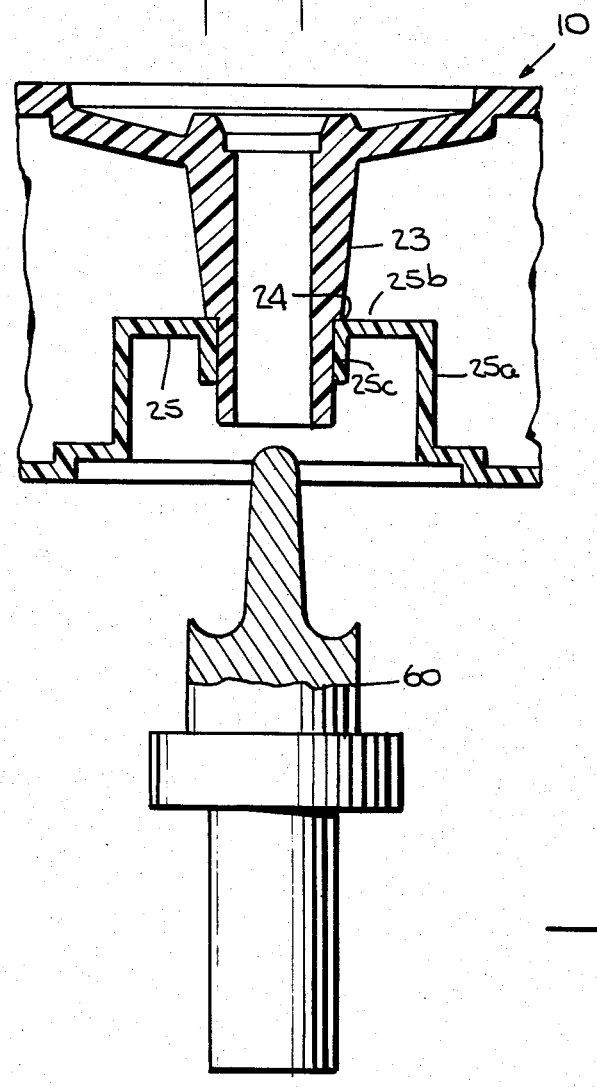
FIG. 10 is a fragmentary view of spool components and a sectional view of a forming tool utilized in making the FIGS. 1 and 9 spools.

Referring now more particularly to FIG. 10 of the drawings, there is represented a fragmentary, sectional view of the spool 10 of FIG. 1 with the tubular portion 23 inserted in the tubular portion 25*c* of the end cap 50 before the tubular portion 23 is formed. There is also represented a fragmentary, sectional view of a suitable rotary tool 60 which can be used to heat by friction and to form the end portion 26 of the tubular portion 23.

Figure 11:
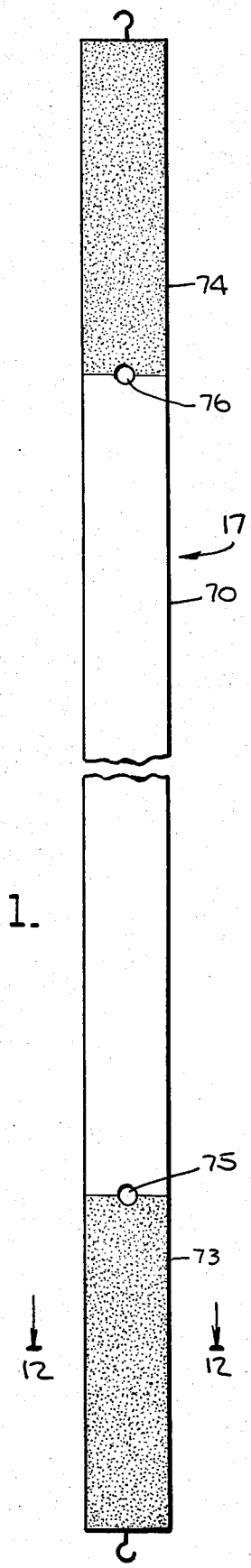
FIG. 11 is a fragmentary plan view of a printing ribbon which may be utilized on the FIG. 1 spool.
Figure 12:
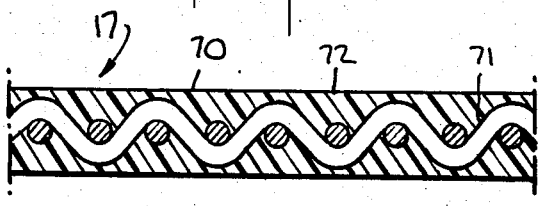
FIG. 12 is a diagrammatic sectional view, to an enlarged scale, of the FIG. 11 ribbon, taken along line 12—12 of FIG. 11.

Referring more particularly to FIGS. 11 and 12, a printing ribbon 17 in accordance with the invention comprises an inking ribbon body 70 having interstices 71 therein for rendering the body 70 ink-absorbent. The ribbon 17 includes a material in the interstices 71 of at least one end portion 73 of the body 70 and forming a coating 72 on the end portion 73 for rendering the end portion 73 non-absorbent to ink. As is apparent in FIG. 11, the ribbon 17 has two end portions 73, 74 and an eyelet 75, 76 for machine use at the beginning of each end portion 73, 74 and, as is apparent in FIG. 12, the material 72 is in the interstices 71 of the two end portions 73, 74 and forms a coating 72 on the end portions 73, 74 for rendering the end portions 73, 74 non-absorbent to ink. The usable printing portion of the ribbon 17 is the length between eyelets 75, 76, and, in the absence of the coating 72 on the end portions 73, 74, ink absorbed by the end portions 73, 74 flows to the adjacent usable portion 70 of the ribbon 17 and renders the printing inconsistent and non-uniform.

The ribbon body 70 preferably is of nylon and may be, for example, a 5 mil ribbon having a thrust count of at least 293. The coating material preferably is polystyrene of a type commercially available from Dow Chemical under the trademark Styron, with a molecular weight in the range of 1000–40,000.

In accordance with the invention, the method of making the printing ribbon 17 comprises applying to an end portion 73 or 74 of the printing ribbon 17 a solution having a plastic material dissolved therein and drying the end portion 73, 74 of the printing ribbon 17 to form a plastic coating 72 on the end portion 73 or 74. This may be done by dipping the end portion of the ribbon 17 in a solution of carbontetrachloride having 20% by weight polystyrene dissolved therein and drying the end portion 73 or 74. The carbon tetrachloride may, for example, be a commercially available product made by SGA Scientific, Bloomfield, N.J., Reag. JTB 1512-3.

The ink may be a commercially available ink made by Image Specialist, Hauppauge, N.Y., with the following characteristics:

Pigment—0–5%
Viscosity—100–500 centipoise
Dye—10–30%
Fatty acid—5–15%
Mineral Oil—0–10%
Vegetable Oil—5–20%
Glycol ether ester—0–25%
Fatty amide—0–3%
Fatty aliphatic naphtha—0–5%

From the foregoing description, it will be apparent that an inking spool 10 constructed in accordance with the invention has numerous advantages. With the interlocking tubular portions 23, 25 of the spool body 11, the spool 10 does not leak even when the spool 10 is shipped by air at less than atmospheric pressure. This is believed to be partially due to the fact that the reduction in pressure outside the spool 10 results in a force inside the spool 10 which tends to press the interlocking tubular portions 23, 25 more tightly together.

The spool 10 provides uniform and consistent printing for millions of characters due to the uniform saturation of the pad 18 provided by the air compensation grooves 11*a*.

The spool 10 has an indefinite shelf life before actuation by the pin 35 which breaks the sealing portion 20*a* of the ink-impervious member 20 separating the ink reservoir 13 from the pad 18.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A printing ribbon spool comprising:

a spool body, at least a portion of an ink reservoir in said spool body, said spool body having spaced flange portions extending outwardly, said spool body having a surface to receive a ribbon wound thereon between said spaced flange portions to define a zone of ribbon wrap, the ribbon advancing toward and from said zone of ribbon wrap when said spool is wound and unwound, respectively;

ink-delivery means for said spool comprising an ink-delivery pad near one of said flange portions, said ink-delivery pad having an exposed portion in the path of the advancing ribbon to contact a portion of the ribbon as the ribbon advances therepast, said ink-delivery pad communicating in ink-receiving relation with said ink reservoir to receive ink from said ink reservoir when said spool is in an operating position and to convey the ink to said exposed portion of said ink-delivery pad;

said spool including ink-impervious means forming a portion of said ink reservoir disposed between said ink-delivery pad and ink in said ink reservoir to isolate said ink-delivery pad from ink in said ink reservoir, said ink-impervious means having at least one breakable portion and said spool including means for breaking said portion to form an opening in said ink-impervious means to permit ink to pass therethrough from said ink reservoir to said ink-delivery pad.

2. A primary ribbon spool in accordance with claim 1 in which said means for breaking said portion of said ink-impervious means comprises a displaceable pin.

3. A printing ribbon spool in accordance with claim 1 in which said spool body has a hub forming at least a portion of said ink reservoir, said hub having a first centrally extending portion having a transverse shoulder therein and said hub having a second centrally extending portion seated against said shoulder and having an end portion, said first centrally extending portion having an end portion extending transversely against second centrally extending portion and completely over said end portion thereof to lock said centrally extending portions in leak-free engagement with each other.

4. An end cap for a printing ribbon spool comprising:

a locking portion having a central aperture for the engagement of a mating member having a transverse shoulder, the mating member being a portion of a spool body portion, said locking portion having a transverse portion adjacent said aperture for seating against the transverse shoulder of the mating member;

an annular portion surrounding said locking portion having an obliquely disposed outer flange portion for positioning a pad thereon for contact with an advancing ribbon on the spool;

said annular portion including a solid annular rib having grooves therein to permit air flow from outside said solid annular rib to within said solid annular rib when said end cap is engaged with the mating member with a pad between the end cap and the spool body portion;

said annular portion having an outer annular groove therein for providing an ink-return channel and at least one transverse groove for providing communication between said ink-return channel and the pad.

5. An end cap in accordance with claim 4 which includes three of said transverse grooves spaced by substantially 120°.

* * * * *

UNITED STATES PATENT AND TRADEMARK OFFICE

CERTIFICATE OF CORRECTION

PATENT NO. : 4,639,153

DATED : January 27, 1987

INVENTOR(S) : Wei-Tsang Cheng

It is certified that error appears in the above-identified patent and that said Letters Patent is hereby corrected as shown below:

Column 8, line 54: for "primary" read -- printing --.

Signed and Sealed this

Eighth Day of September, 1987

*Attest:*

DONALD J. QUIGG

*Attesting Officer*

*Commissioner of Patents and Trademarks*